US005931537A

United States Patent [19]

Gollin et al.

[11] Patent Number: 5,931,537

[45] Date of Patent: Aug. 3, 1999

[54] ADJUSTABLE CHAIR ARM ASSEMBLY

[75] Inventors: Timothy J. Gollin, Houston, Tex.; Cole J. Dalton, Snohomish, Wash.

[73] Assignee: Gollin & Co., Inc., Houston, Tex.

[21] Appl. No.: 08/941,708

[22] Filed: Sep. 30, 1997

[51] Int. Cl.[6] ..... A47C 7/54

[52] U.S. Cl. ..... 297/411.36; 297/411.35; 297/411.32; 297/411.27

[58] Field of Search ..... 297/411.36, 411.35, 297/411.32, 411.27, 411.26; 248/118.3; 403/13

[56] References Cited

U.S. PATENT DOCUMENTS

| | | | |
|---|---|---|---|
| 4,311,338 | 1/1982 | Moorhouse . | |
| 4,884,846 | 12/1989 | Tobler . | |
| 4,951,995 | 8/1990 | Teppo et al. . | |
| 4,961,610 | 10/1990 | Reeder et al. . | |
| 5,318,347 | 6/1994 | Tseng . | |
| 5,368,365 | 11/1994 | Feldberg . | |
| 5,377,943 | 1/1995 | Perl . | |
| 5,382,079 | 1/1995 | Wilson et al. . | |
| 5,388,892 | 2/1995 | Tornero . | |
| 5,393,124 | 2/1995 | Neil . | |
| 5,393,125 | 2/1995 | Watson et al. | 297/411.36 |
| 5,407,249 | 4/1995 | Bonutti . | |
| 5,439,267 | 8/1995 | Peterson et al. . | |
| 5,599,067 | 2/1997 | Schuelke et al. . | |
| 5,620,233 | 4/1997 | Corwin | 297/411.36 |
| 5,647,638 | 7/1997 | Ritt et al. | 248/118.3 |

*Primary Examiner*—Anthony D. Barfield
*Attorney, Agent, or Firm*—Kuffner & Assoicates

[57] ABSTRACT

A vertically and rotatably adjustable chair arm assembly is secured to a support tube mounted to a chair seat. The chair arm assembly includes a lower outer shell and a plastic sleeve received within an axial bore of the outer shell. A plastic collet is concentrically positioned within the sleeve. The plastic collet includes upstanding positioning tabs adapted for engagement with longitudinally extending alignment grooves formed on the interior surface of the sleeve. The chair arm assembly is secured on the support tube by sliding the sleeve and outer shell slide over the outer surface of the support tube. The plastic collet extends into the upper end of the support tube so that the metal support tube surface is sandwiched between the plastic sleeve and the plastic collet. A lock mechanism having a locking arm telescopically positioned within the plastic collet is pivotally connected to the outer shell. The lock mechanism may be manually engaged by the user to move the locking arm between a locked position at which it engages the internally threaded plastic collet and an unlocked position which permits vertical adjustment of the chair arm with respect to the support tube and plastic collet. A swing and lock bracket assembly mounts the support tube and chair arm assembly to the bottom of the chair seat.

19 Claims, 6 Drawing Sheets

FIG. 5
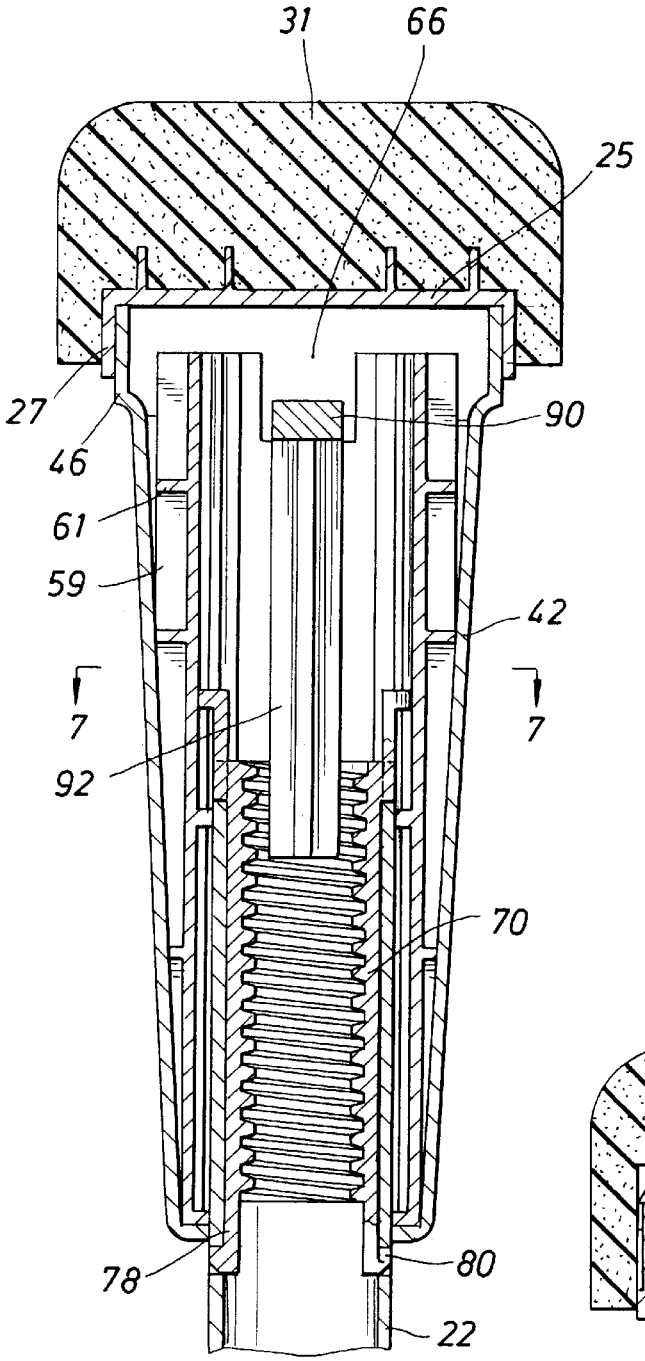
FIG. 7
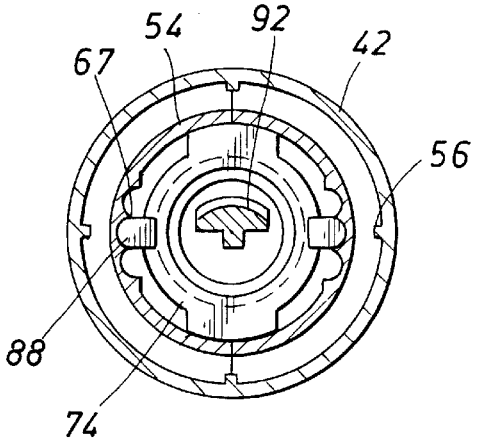
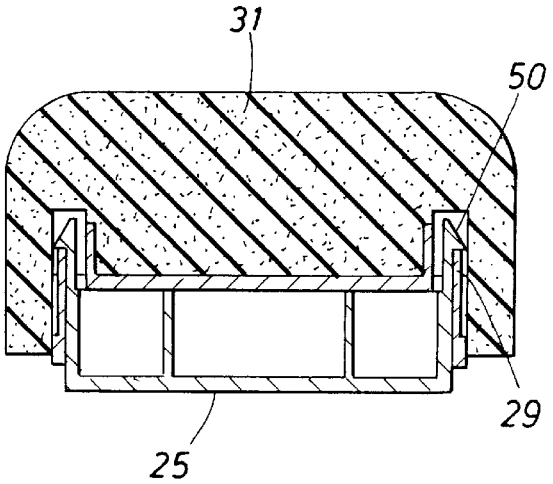
FIG. 6

ADJUSTABLE CHAIR ARM ASSEMBLY

BACKGROUND OF THE INVENTION

The present invention relates to chairs, and more particularly to a chair arm assembly which is vertically adjustable and rotatable with respect to a chair seat.

The chair design industry has heretofore provided a wide variety of chairs for the office environment which are ergonomically designed for the comfort of the user. These chairs include various adjustment mechanisms to accommodate the needs of particular users. The chairs may, for example, include vertically adjustable seat height mechanisms, swivel and tilt mechanisms and reclining back mechanisms. Some chairs provided arm assemblies which are adjustable vertically and horizontally relative to the chair seat.

Typically, height adjustable chair arms are plastic assemblies which fit over plastic and metal supports. The plastic and/or metal supports provide the structural strength for the chair arm assembly. These adjustable chair arms typically utilize screw fastening systems and punched or slotted metal tube or brackets to provide engagement for the height adjustment mechanism. Many height adjustable arms having a plastic height adjustment assembly on a metal substructure encounter problems with wobble and may rattle or feel loose, particularly at the top of the height adjustment range. In addition, in many of these height adjustment mechanisms the actuation of the height adjustment feature requires the user to remove his hand from an at-work position in order to move a lever or other actuating device to adjust the chair arm.

A need exists for a chair arm assembly which is adapted for vertical and rotational height adjustment, which permits a wide latitude in vertical and rotational positioning of the chair arm assembly, which is relatively easily manufactured, which is reliable in operation and which provides a wide variety of adjustable positions for the user.

It is, therefore, an object of the invention to provide an chair arm assembly which may be adjusted vertically and rotationally, and which may be optionally pivoted forward and backward.

It is a further object of the invention to provide an adjustable chair arm assembly in which the height adjustment mechanism utilizes a plastic collet with an internal threaded surface providing plastic-on-plastic engagement for ease of use and positive engagement of the locking mechanism.

It is a further object of the invention to provide an adjustable chair arm assembly which utilizes a split plastic sleeve for locating the arm assembly on a metal support tube and eliminating bearing surface wobble.

It is a further object of the invention to provide a spring actuated rotational device which permits the chair arm assembly of the invention to move backward as the chair is pushed close to a desk or other fixed surface, and further, to enable the user to retract the chair arms so that they are aligned approximately with the incline of the back of the chair, thereby making the chair essentially "armless."

It is a further object of the invention to facilitate the assembly of the arm to a chair frame built of steel tube produced by a chair manufacturer, thus enabling flexibility of design in terms of tube shape and orientation, without necessitating redesign of the arm. Thereby, enabling the chair manufacturer to employ a set of components which may be fitted to, and integrated with, a variety of chair frame designs, without the need of a separate metal substructure.

It is yet another object of the invention to provide an adjustable chair arm assembly which permits the entire arm assembly to swivel on the metal support tube without disengagement of the height adjustment locking mechanism.

SUMMARY OF THE INVENTION

The present invention provides a chair arm assembly attachable to a chair seat. The chair arm assembly of the invention is vertically and rotatably adjustable. The chair arm assembly includes a support tube having a generally straight uppermost section. The chair arm assembly further includes an arm pad subassembly mounted on the generally straight section of the support tube. The arm pad subassembly includes a lower outer shell and a split plastic sleeve received within an axial bore of the outer shell. A plastic collet is concentrically positioned within the split sleeve. The plastic collet includes upstanding positioning tabs adapted for mating engagement with longitudinally extending alignment grooves formed on the interior surface of the split sleeve. The arm pad subassembly is secured on the upper section of the support tube by positioning the subassembly over the tube whereby the split sleeve and outer shell slide on the outer surface of the support tube and the plastic collet extends into the upper section of the support tube so that the metal support tube surface is sandwiched between the plastic split sleeve and the plastic collet. A lock mechanism having a locking arm telescopically positioned within the plastic collet is pivotally connected to the outer shell. The lock mechanism may be manually engaged by the user to move the locking arm between a locked position at which it engages the internally threaded plastic collet and an unlocked position which permits vertical adjustment of the chair arm with respect to the support tube and plastic collet. A swing and lock bracket assembly mounts the support tube and chair arm assembly to the chair seat.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 5 is a section view of the chair arm of the invention taken along line 5—5 of FIG. 4;

FIG. 6 is a section view of the chair arm of the invention taken along line 6—6 of FIG. 4;

FIG. 7 is a section view of the chair arm of the invention taken along line 7—7 of FIG. 5;

DETAILED DESCRIPTION OF A PREFERRED EMBODIMENT

Figure 1:
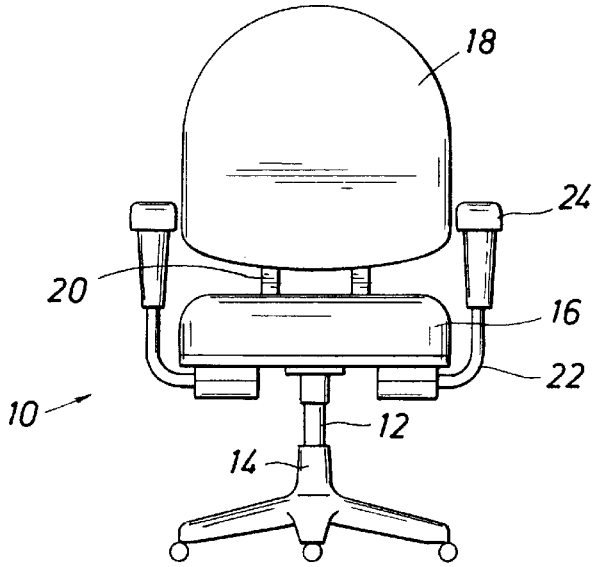
FIG. 1 is a front view of a chair incorporating an adjustable chair arm in accordance with the present invention.

A chair including an adjustable arm assembly in accordance with the present invention is illustrated in FIG. 1 and generally identified by the reference numeral 10. The chair 10 includes a support pedestal 12 mounted on a castered base 14. A chair seat 16 is supported on the pedestal 12 in a well known manner. A chair back 18 is mounted to the seat 16 by brace members 20. A generally L-shaped armrest support tube 22 is mounted on opposite sides of the chair seat 16 in a manner to be described in greater detail later herein. The support tube 22 is hollow and includes a generally vertically extending upper section terminating in a open end. Armrests 24 are positioned on the ends of the upper section of each support tube 22.

Figure 2:
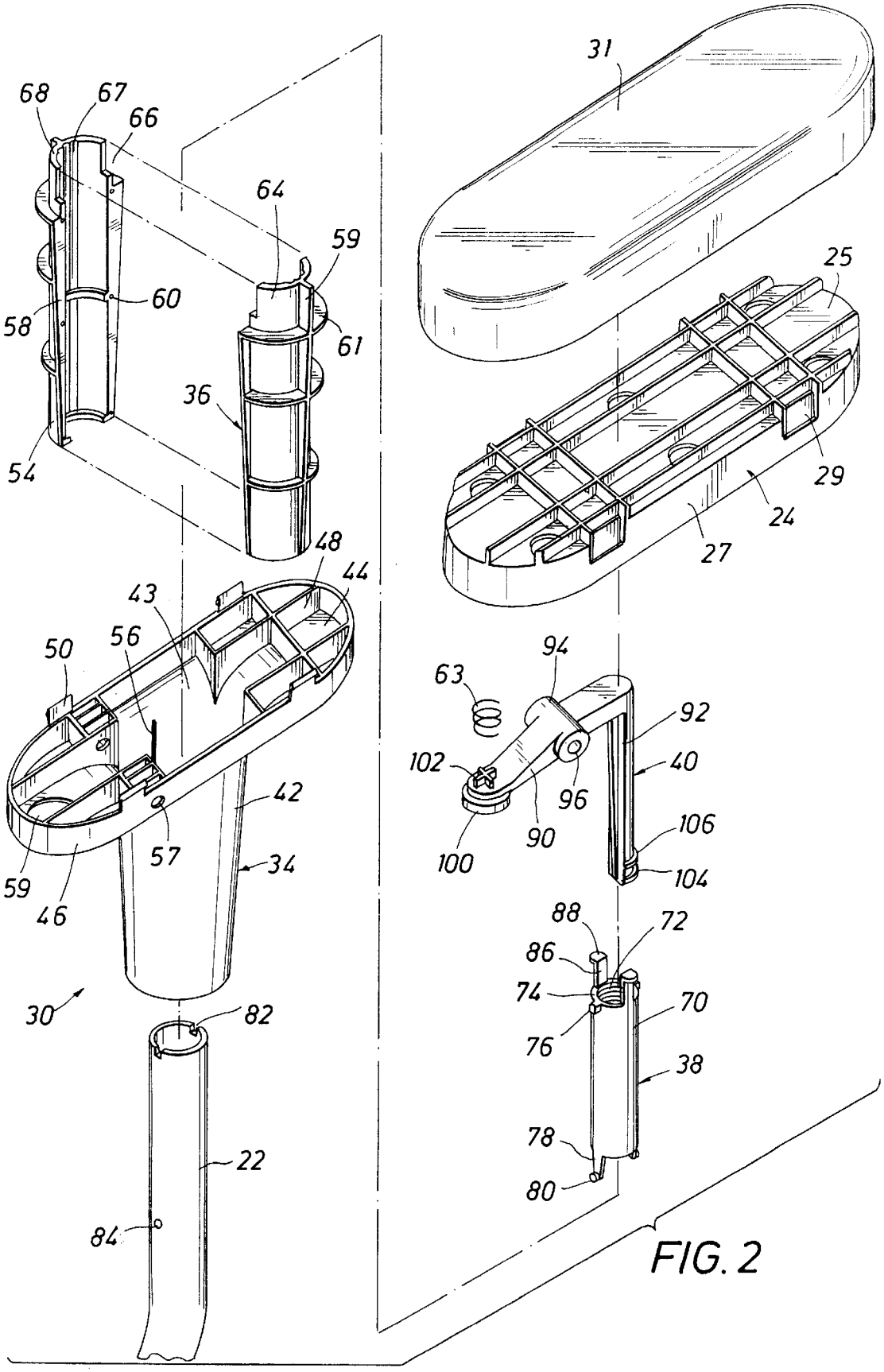
FIG. 2 is an exploded view of the adjustable chair arm assembly of the invention.

Referring now to FIG. 2, an embodiment of the adjustable chair arm assembly of the present invention is generally identified by the reference numeral 30. The arm assembly 30 provides for vertical height adjustment of the armrests 24 with respect to the chair seat 16 and the support tube 22. Additionally, the arm assembly 30 provides for rotatable or side to side adjustment of the armrests 24 with respect to the support tube 22. Each chair arm assembly 30 includes the support tube 22 and a subassembly including an outer shell 34, a split sleeve 36, a collet liner 38, a lock mechanism 40 and the armrest 24.

Figure 3:
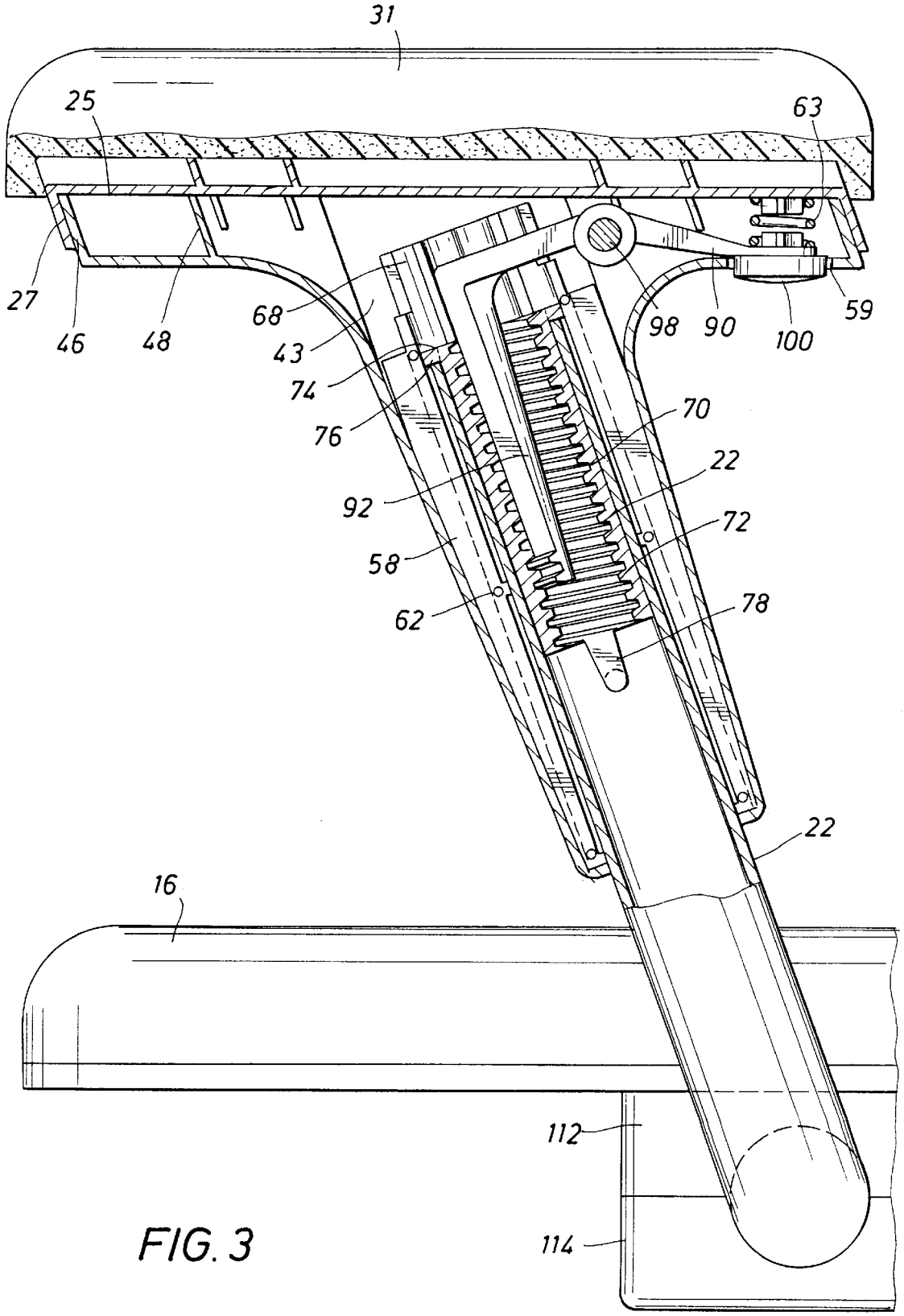
FIG. 3 is a partial section view of the adjustable chair arm assembly of the invention depicting the chair arm is the locked position.
Figure 4:
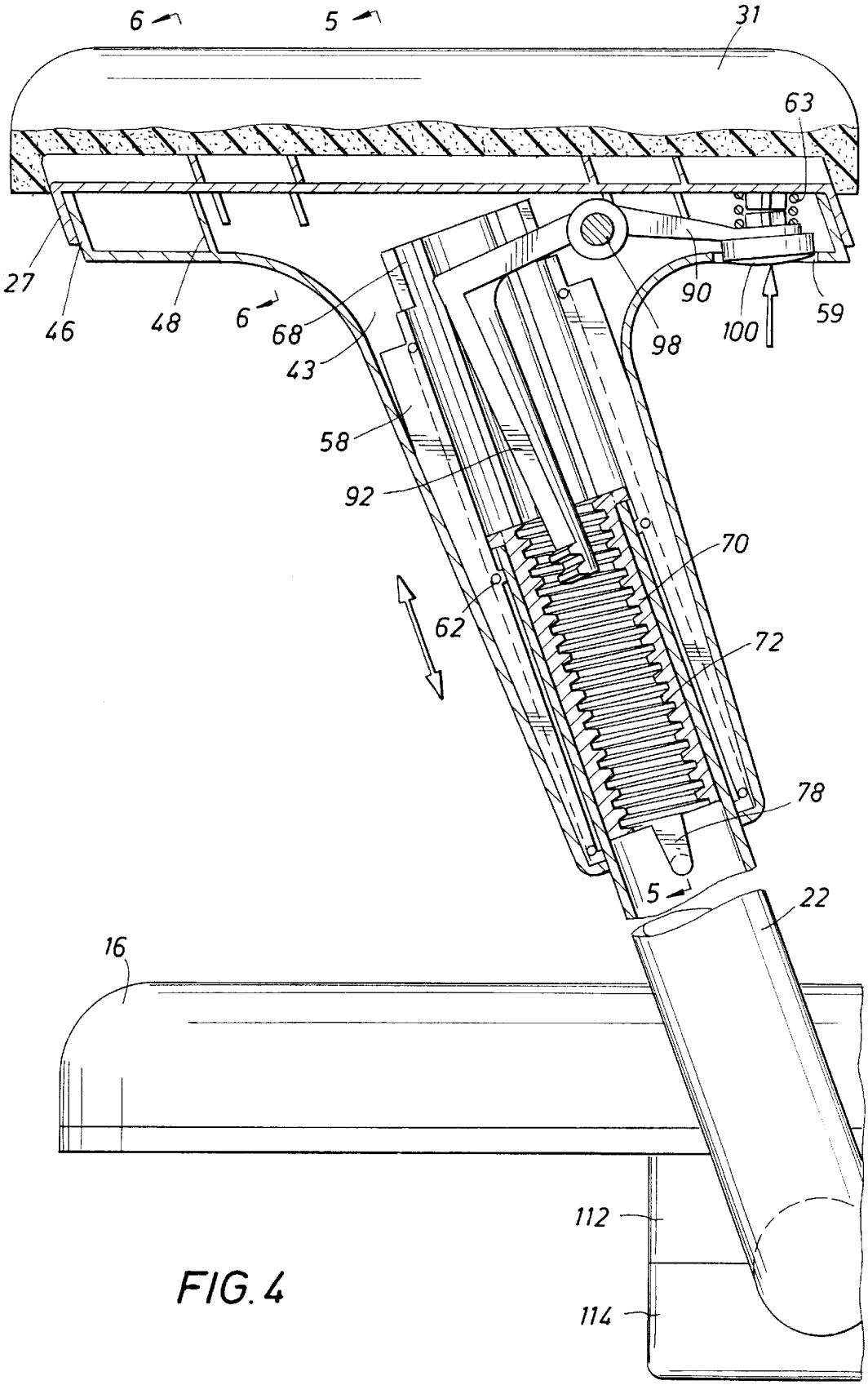
FIG. 4 is a partial section view of the adjustable chair arm of the invention depicting the chair arm in the unlocked position for being raised or lowered on the chair arm support tube.

The outer shell 34 includes a generally tubular, elongated body 42. The body 42 is open at each end and includes an axial passageway 43, as best shown in FIG. 3, extending therethrough. The upper end of the body 42 forms a generally elliptical, horizontal base 44. The base 44 includes an upstanding circumferential flange 46. The base 44 and circumferential flange 46 define an open cavity subdivided by a plurality of upstanding vanes 48 joining the base 44 and the flange 46 adding to the structural integrity of the base 44. Several connector tabs 50 project upwardly from the flange 46 for interlocking engagement with the armrest 24.

The armrest 24 includes a base 25 and a circumferential flange 27 extending downwardly therefrom. The dimensions of the flange 27 are slightly greater than the dimensions of the flange 46 as shown in FIG. 3. Upon assembly with the outer shell 34, the armrest 24 slides over the flange 46. The connector tabs 50 snap into locking engagement upstanding locking members 29 formed on the flange 29 of the armrest 24. The upper surface of the armrest 24 is covered by an arm pad 31.

Referring now to FIGS. 2 and 3, the outer shell 34 is adapted to receive a split sleeve 36 in the axial passageway 43. The split sleeve 36 comprises two substantially cylindrical halves 54 which mate together to form an open ended cylinder. The cylindrical halves 54 include longitudinal edges 58 which upon assembly of the split sleeve 52 are in facing engagement. Alignment of the cylindrical halves 54 is maintained by a combination of holes and pins formed on the edges 58 of the cylindrical halves 54. One of the cylindrical halves 54 includes two or more tapped holes 60 formed in the edge 58 of the split sleeve halve 54. The other cylindrical halve 54 includes a corresponding number of pins 62 projecting from its edges 58. The holes 60 and pins 62 are spaced along the edges 58 and are oppositely aligned. Upon assembly of the sleeve 52, the pins 62 are received in the holes 60 for holding the two cylindrical halves 54 together.

In addition to the longitudinal edges 58, the split sleeve 36 includes longitudinal flanges 59 projecting radially outwardly from the outer surface of the split sleeve halves 54. The flanges 59 extend from the upper to the lower end of the split sleeve halves 54 located at about the midpoint between the longitudinal edges 58. The longitudinal edges 58 and flanges 59 taper inwardly from the upper ends to the lower ends thereof. The taper profile of the edges 58 and flanges 59 corresponds tot the taper of the outer shell 34 so that upon assembly, the edges 58 and flanges 59 are in snug contact with the inner surface of the outer shell 34, thereby eliminating the tendency of the chair arm to wobble as it is raised and lowered on the support tube 22.

Chair arm wobble is further reduced by a plurality of circumferential flanges 61 extending radially outwardly and vertically spaced along the outer surface of the split sleeve 36. The external diameter of the flanges 61 decreases from the uppermost to the lowermost flange 61 to accommodate the tapering profile of the shell housing 34. The circumferential flanges 61 are provided with aligned slots formed in the outer edges thereof for receiving therein longitudinal ribs 56 formed on the interior surface of the axial passageway 43 of the outer shell 34. The ribs 56 interlock with the circumferential flanges 61 to prevent relative rotation between the split sleeve 36 and the outer shell 34.

Referring still to FIG. 2, it will be observed that upper ends of the cylindrical halves 54 of the split sleeve 36 define extensions 64 which are offset from the edges 58. When the two cylindrical halves 54 are joined together, a slot 66 is formed between the extensions 64 in the upper end of the sleeve 36.

Internal longitudinal grooves 67, as best shown in FIG. 7, are formed on the internal surface of the cylindrical halves 54. The grooves 67 extend from the upper edge 68 of the extensions 64 to the lower end of the cylindrical halves. The grooves 67 cooperate with the collet liner 38 to permit side to side rotation of the chair arm assembly in a manner to be described in greater detail later herein.

The collet liner 38 includes an open ended cylindrical body 70. The body 70 is internally threaded. The thread profile of the threads 72 is rounded allowing easy engagement and disengagement with the lock mechanism 40 and permitting the chair arm assembly to be easily adjusted vertically. The upper end of the collet 38 liner includes a circumferential flange 74. The flange 74 is provided with a pair of oppositely located tabs 76 which extend downwardly from the bottom of the flange 74. The tabs 76 are vertically aligned with extension members 78 projecting downwardly from the bottom edge of the collet liner 38. The extension members 78 further include outwardly projecting pins 80. The tabs 76 and pins 80 are profiled to be received in slots 82 and holes 84, respectively, formed in the support tube 22. Engagement of the tabs 76 and pins 80 in the slots 82 and holes 84 secures the collet liner 38 to the support tube 22 so that the collet liner 38 will not rotated relative to the support tube 22 or become disengaged therefrom when the chair arm assembly is adjusted vertically.

Referring again to FIG. 2, it will be observed that the collet liner 38 is provided with a pair of upstanding collet fingers 86 having detents 88 projecting outwardly therefrom. The collet fingers 86 extend upwardly from the collet flange 74 above the tabs 76. The detents 88 are configured to mate with the internal longitudinal grooves 67 formed in the split sleeve 36, as best shown in FIG. 7. The collet fingers 86 are flexible so that when the chair arm is rotated, the collet fingers 86 flex inwardly permitting the detents 88 to retract from one groove 67 and snap into the adjacent groove 67. The feel of the "snap" signifies to the user that the chair arm is locked in the next rotational location.

The chair arm of the invention, as noted above, may be raised or lowered on the support tube 22 and is locked in the desired position by a lock mechanism 40. Referring again to FIG. 2, the lock mechanism 40 includes a horizontal member 90 and an arm 92 extending downwardly from the distal end of the horizontal member 90. The horizontal member 90 includes an enlarged portion 94 at about the midpoint thereof. An axial bore 96 extends through the enlarged portion 94 for receiving a pivot pin 98 therethrough. The proximal end of the horizontal member 90 terminates in a downwardly projecting actuation button 100 and an upwardly extending spring holder 102. The arm 92 is approximately 3 to 4 inches in length and terminates in an externally threaded head 104. The profile of the threads 106 of the lock head 104 are rounded for cooperative engagement with the threads 72 of the collet liner 38.

The lock mechanism 40 is pivotally mounted to the outer shell 34 by inserting the arm 92 into the collet liner 38 and aligning the bore 96 with spaced holes 57 formed in the flange 46 of the outer shell 34. The horizontal member 90 is received in a slot formed between the vanes 48 of the base 44 so that the actuation button 100 projects through a hole 59 formed in the base 44. The pivot pin 98 is inserted through the aligned bore 96 and holes 57 thereby pivotally mounting the lock mechanism 40 to the base 44 of the outer shell 34. A spring 63 having one end anchored about the spring holder 102 is compressed by the armrest 24 when it is snapped on the base 44. The downward force of the spring 63 pivots the horizontal member 90 downwardly thereby forcing the threaded head 104 of the arm 92 into locking engagement with the collet liner 38.

Figure 8:
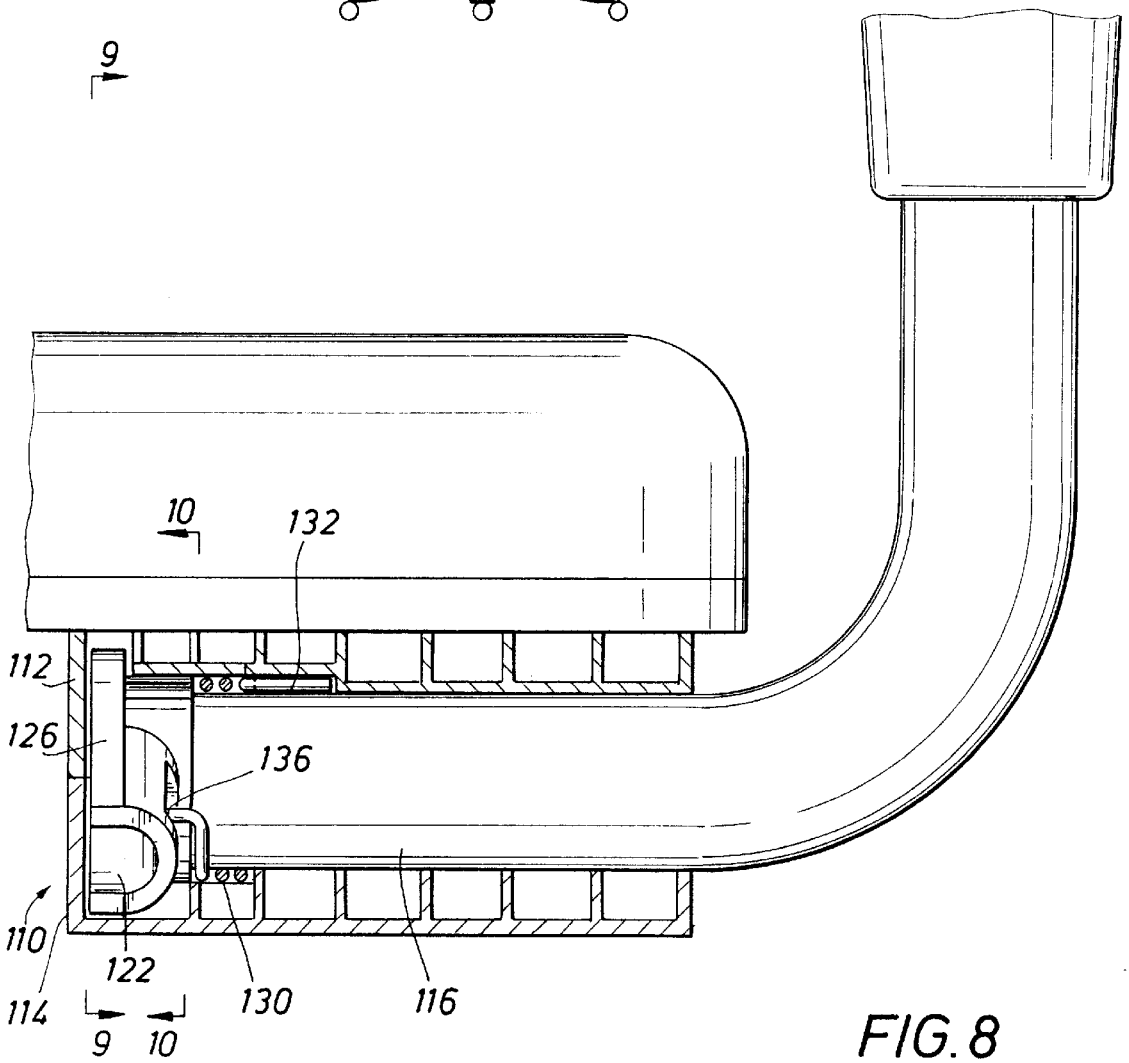
FIG. 8 is a partial section view of the lock bracket assembly mounting the chair arm assembly of the invention to the bottom of a chair seat.
Figure 9:
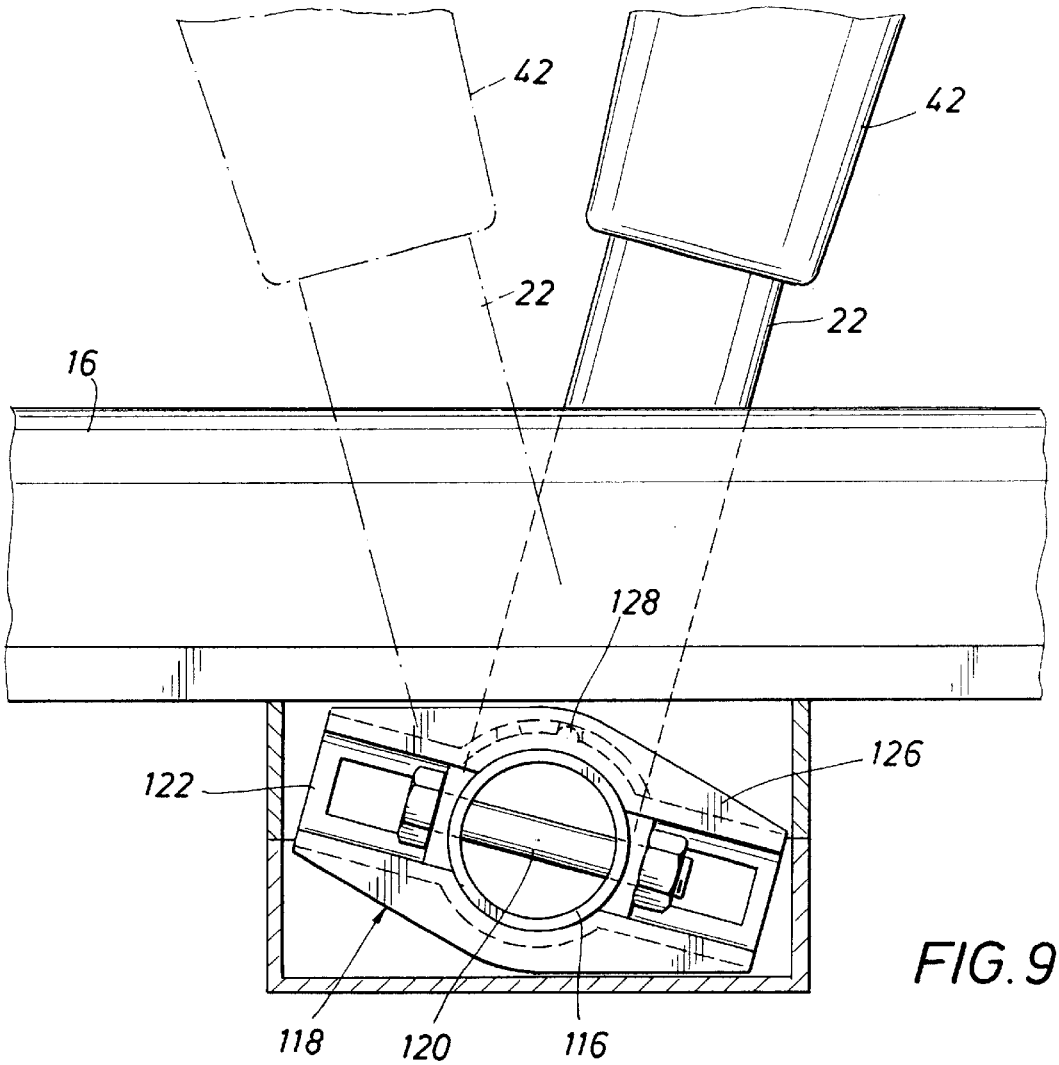
FIG. 9 is a partial section view taken along line 9—9 of FIG. 8 depicting the lock bracket assembly mounting the chair arm of the invention to a chair seat and illustrating the forward and backward movement of the chair arm.
Figure 10:
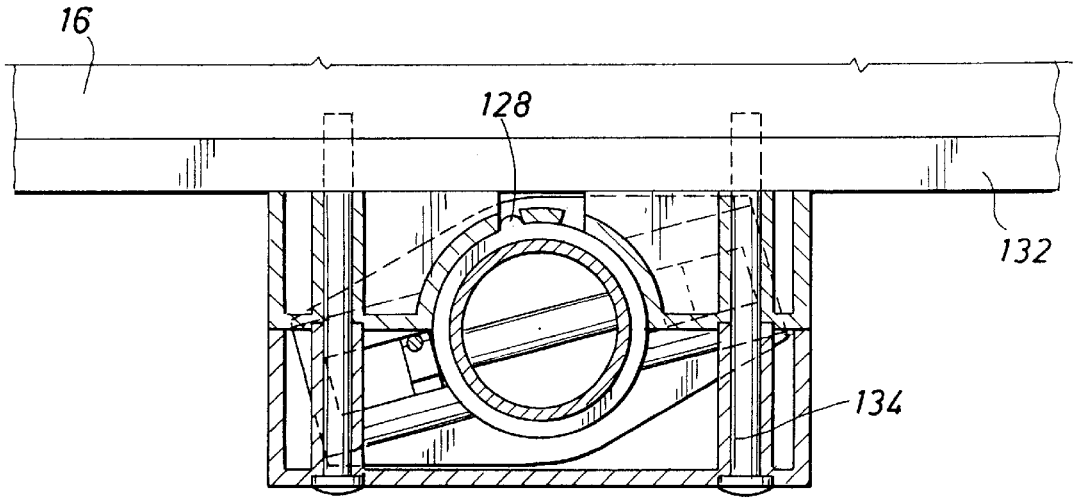
FIG. 10 is a partial section view taken along line 10—10 of FIG. 8 depicting the rotation limiter of the invention.

Referring now to FIGS. 8–10, the swing and lock bracket of the invention is shown. Office chairs typically interfere with desks when the chair is pulled in close to the desk. The swing and lock bracket generally identified by the referenced numeral 110 permits the chair arm of the invention to pivot back out of the way when the chair is brought close to the desk. The swing and lock bracket 110 includes a top member 112 and a bottom member 114 which upon assembly form an axial bore for receipt of the lower end 116 of the support tube 22. The swing and lock bracket also includes a rotation limiter 118 which is journaled about the end 116 of the support tube 22. A mounting bolt 120 securely mounts the rotation limiter 118 on the support tube 22. The rotation limiter 118 is provided with a longitudinally extending slot 122, which upon being journalled on the support tube 22 is aligned with a hole formed proximate the end of the support tube 22. Upon alignment of the slot 122 with the hole formed in the end 116 of the support tube 22, the bolt 120 is inserted to lock the rotation limiter 118 on the end 116 of the support tube 22.

The rotation limiter 118, as best shown in FIG. 9, includes tapered upstanding flanges 126. The flanges 126 taper from the midpoint thereof toward the opposite ends of the rotation limiter 118. The tapered flanges 126 permit the rotation limiter 118 to rotate about one quarter turn about its rotational axis so that the chair arm may be moved about 8 to 10 inches back from its most forward position. A detent 128 formed on the hub of the rotation limiter 118 cooperates with top clamp member 112 to provide a "snap" feel when the chair arm is locked in a rearward position.

A spring 130 maintains the chair arm in a forward or at rest position. The spring 130 is journalled about the end 116 of the support tube 22, as shown in FIG. 8. One end 136 of the spring 130 is anchored to a detent formed on the rotation limiter 118. The other end 138 of the spring 130 is secured to top member 112 of the bracket assembly. As the chair arm is pivoted forward, the spring 130 is placed in tension. As the chair arm is pivoted in the rearward direction the spring tension is relieved and the chair arm is maintained in the rearward locked position.

Upon assembly of the swing and lock bracket on the lower end 116 of the support tube 22, it is mounted on the bottom 132 of the chair seat 16. A plurality of bolts 134 which extend through the assembled top and bottom members 112 and 114, secure the lock bracket to the bottom 132 of the chair seat 16.

In use, the chair arm assembly of the present invention permits the user to raise or lower the chair arm by actuation of the button 100 which projects through the hole 59 in the base 44 of the outer shell 34. The user may conveniently depress the button 100 without removing his arm from the armrest to release the arm 92 from locking engagement with the collet liner 38 and simultaneously raise the armrest and outer shell assembly. Upon release of the button 100, the arm 92, under the action of the spring automatically re-engages the internal threads of the collet liner 38. The user may also rotate the chair arm from side to side as needed for any particular task. Rotation of the chair arm may be accomplished at any vertical location of the chair arm on the support tube 22 or simultaneously while raising or lowering the chair arm. As the chair arm is rotated from side to side it makes an audible "click" as the detents 88 snap into the longitudinal grooves 67 of the split sleeve 36 of the next rotational position.

While a preferred embodiment of the invention has been shown and described, other and further embodiments of the invention may be devised without departing from the basic scope thereof, and the scope thereof is determined by the claims which follow.

We claim:

1. An adjustable armrest for a chair, comprising:

a) an armrest support tube having upper and lower ends;

b) an armrest having a downwardly depending shell housing, said shell housing having an axial bore extending from a top end to a bottom end and a horizontal base extending outwardly from the top end of said shell housing;

c) a sleeve telescopically positioned within said axial bore of said shell housing, said shell housing and said sleeve being journalled about the upper end of the support tube;

d) a collet liner telescopically received within the upper end of said support tube;

e) a lock mechanism pivotally connected to said shell housing in locking engagement with said collet liner; and f) bracket means connecting the lower end of said support tube to a chair seat.

2. The adjustable armrest of claim 1 including means for locking said shell housing and said sleeve against relative rotational movement.

3. The adjustable armrest of claim 2 wherein said collet liner includes a cylindrical body defining an axial bore, said cylindrical body being internally threaded, and further including outwardly projecting locking pins located at a lower end of said cylindrical body and flexible extensions projecting upwardly from an upper end of said cylindrical body.

4. The adjustable armrest of claim 3 wherein said sleeve includes longitudinal guide grooves formed on an internal surface of said sleeve for engagement with said flexible extensions of said collet liner.

5. The adjustable armrest of claim 4 wherein said lock mechanism includes a horizontal member and an arm member extending downwardly from one end of said horizontal member, said arm member terminating in a threaded head for locking engagement with the threaded bore of said collet liner.

6. The adjustable armrest of claim 5 wherein said lock mechanism includes a spring actuated release button located on said horizontal member opposite said downwardly extending arm member.

7. The adjustable armrest of claim 6 wherein said bracket means includes a top and bottom clamp member secured about the lower end of said support tube, said bracket means further including a rotation limiter journaled about the lower end of said support tube between said top and bottom clamp members.

8. The adjustable armrest of claim 7 wherein said armrest is adapted to be simultaneously raised or lowered and rotated from side to side.

9. The adjustable armrest of claim 1 wherein said sleeve is split into two substantially identical halves.

10. The adjustable armrest of claim 1 wherein said sleeve includes longitudinally extending flanges projecting radially outwardly from an outer surface of said sleeve, said longitudinal flanges tapering inwardly from an upper end to a lower end of said sleeve.

11. An adjustable chair arm assembly, comprising:

a) an armrest support tube having upper and lower ends;

b) an armrest having a downwardly depending shell housing, said shell housing having an axial bore extending from a top end to a bottom end and a horizontal base extending outwardly from the top end of said shell housing;

c) a sleeve telescopically positioned within said axial bore of said shell housing, said shell housing and said sleeve being journalled about the upper end of said support tube;

d) an internally threaded collet liner telescopically received within the upper end of said support tube;

e) a lock mechanism pivotally connected to said shell housing in locking engagement with said collet liner; and f) bracket means connecting the lower end of said support tube to a chair seat.

12. The chair arm assembly of claim 11 wherein said collet liner includes flexible extensions projecting upwardly from an upper end thereof, said sleeve including longitudinal guide grooves formed on an internal surface of said sleeve for engagement with said flexible extensions of said collet liner.

13. The chair arm assembly of claim 11 wherein said lock mechanism includes a horizontal member and an arm member extending downwardly from one end of said horizontal member, said arm member terminating in a threaded head for locking engagement with a threaded bore of said collet liner.

14. The chair arm assembly of claim 11 wherein said sleeve includes longitudinally extending flanges projecting radially outwardly from an outer surface of said sleeve, said longitudinal flanges tapering inwardly from an upper end to a lower end of said sleeve.

15. An adjustable armrest for a chair, comprising:

a) an armrest support tube having upper and lower ends;

b) an armrest having a downwardly depending shell housing, said shell housing having an axial bore extending from a top end to a bottom end and a horizontal base extending outwardly from the top end of said shell housing;

c) a sleeve telescopically positioned within said axial bore of said shell housing, said sleeve being split into two substantially identical halves, and wherein said shell housing and said sleeve are journalled about the upper end of the support tube;

d) a collet liner telescopically received within the upper end of said support tube;

e) a lock mechanism pivotally connected to said shell housing in locking engagement with said collet liner; and f) bracket means connecting the lower end of said support tube to a chair seat.

16. The adjustable armrest of claim 15 wherein said lock mechanism includes a horizontal member and an arm member extending downwardly from one end of said horizontal member, said arm member terminating in a threaded head for locking engagement with a threaded bore of said collet liner.

17. The adjustable armrest of claim 16 wherein said lock mechanism includes a spring actuated release button located on said horizontal member opposite said downwardly extending arm member.

18. The adjustable armrest of claim 15 wherein said bracket means includes a top and bottom clamp member secured about the lower end of said support tube, said bracket means further including a rotation limiter journaled about the lower end of said support tube between said top and bottom clamp members.

19. The adjustable armrest of claim 15 wherein said armrest is adapted to be simultaneously raised or lowered and rotated from side to side.

* * * * *